US006550201B2

(12) United States Patent
Hoffman et al.

(10) Patent No.: US 6,550,201 B2
(45) **Date of Patent: *Apr. 22, 2003**

(54) DECK CONSTRUCTION

(75) Inventors: Paul Hoffman, Alvadore, OR (US); Sam H. Bright, Eugene, OR (US)

(73) Assignee: Pro Shop Plans Co., Inc., Eugene, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/886,737

(22) Filed: Jun. 21, 2001

(65) Prior Publication Data

US 2001/0032427 A1 Oct. 25, 2001

Related U.S. Application Data

(63) Continuation of application No. 09/360,372, filed on Apr. 28, 1999, now Pat. No. 6,324,801, which is a continuation of application No. 08/716,507, filed on Sep. 17, 1996, now Pat. No. 5,953,874, which is a continuation of application No. 08/364,659, filed on Dec. 27, 1994, now abandoned, which is a continuation of application No. 07/976,611, filed on Nov. 16, 1992, now Pat. No. 5,392,575, which is a continuation of application No. 07/745,995, filed on Aug. 9, 1991, now abandoned, which is a continuation of application No. 07/292,742, filed on Jan. 3, 1989, now abandoned, application No. 09/886,737, which is a continuation of application No. 07/763,870, filed on Sep. 19, 1991, now Pat. No. 5,163,967, which is a continuation of application No. 07/507,002, filed on Apr. 10, 1990, now abandoned, which is a continuation of application No. 07/319,852, filed on Mar. 3, 1989, now abandoned, which is a continuation of application No. 07/101,832, filed on Sep. 28, 1987, now abandoned, which is a continuation-in-part of application No. 06/926,291, filed on Nov. 3, 1986, now Pat. No. 4,724,642.

(51) Int. Cl.[7] ..... E02D 27/32
(52) U.S. Cl. ..... 52/299; 52/296; 52/298
(58) Field of Search ..... 52/169.9, 296, 52/297, 298, 299

(56) References Cited

U.S. PATENT DOCUMENTS

| | | | | |
|---|---|---|---|---|
| 3,505,764 A | * | 4/1970 | Gutierrez | 52/126.5 |
| 3,706,168 A | * | 12/1972 | Pilish | 52/294 |
| 4,328,651 A | * | 5/1982 | Gutierrez | 52/169.9 |

FOREIGN PATENT DOCUMENTS

| | | | | |
|---|---|---|---|---|
| AU | 2809430 | * | 7/1930 | 52/294 |
| DE | 3014523 | * | 10/1981 | 52/299 |
| EP | 39614 | * | 5/1981 | 52/299 |
| FR | 1413829 | * | 1/1966 | 52/299 |
| SU | 705086 | * | 12/1979 | 52/297 |
| SU | 777185 | * | 11/1980 | 52/298 |

* cited by examiner

*Primary Examiner*—Michael Safavi
(74) *Attorney, Agent, or Firm*—Welsh & Katz, Ltd.

(57) ABSTRACT

A deck construction including a plurality of supports for anchoring deck construction elements to a building site. The supports include a body (which may be an integrally molded concrete pier) having upper and lower portions. The upper portion includes at least one slot for seating a horizontally oriented construction member. The slot includes a center socket portion having four extended corners for seating the bottom end of a vertically oriented construction member. The slot and center socket are defined by connecting wall portions which may be integral to the body or may be of plastic or metal and suitable secured to the body. In some cases, two mutually perpendicular slots are provided.

3 Claims, 10 Drawing Sheets

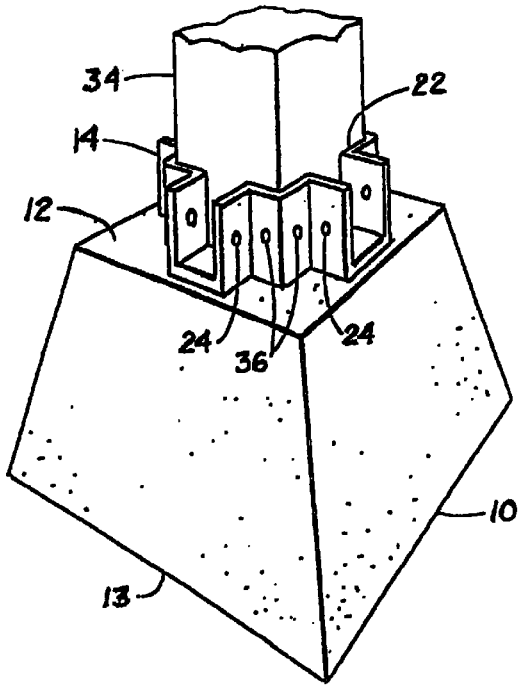
FIG.7
FIG. 8
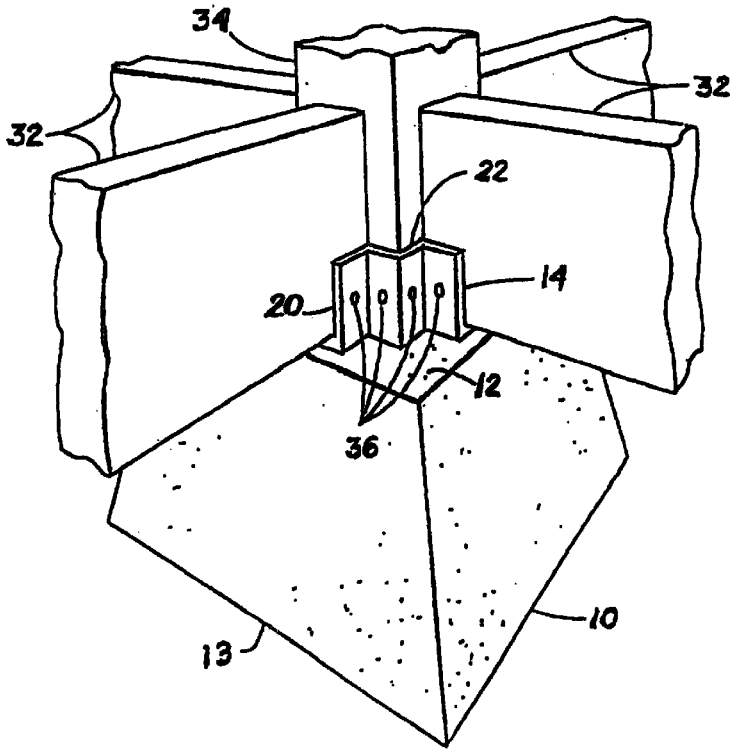

DECK CONSTRUCTION

REFERENCE TO PRIOR APPLICATIONS

This is a continuation application from Ser. No. 09/360,372, filed Apr. 28, 1999, U.S. Pat. No. 6,324,801, which is a continuation of application Ser. No. 08/716,507, filed Sep. 17, 1996, U.S. Pat. No. 5,953,874, which is a continuation of application Ser. No. 08/364,659, filed Dec. 27, 1994 (abandoned), which is a continuation of Ser. No. 07/976,611, filed Nov. 16, 1992, U.S. Pat. No. 5,392,575, which is a continuation of Ser. No. 07/745,995, filed Aug. 9, 1991 (abandoned), which is a continuation of Ser. No. 07/292,742, filed Jan. 3, 1989 (abandoned), and a continuation of Ser. No. 07/763,870, filed Sep. 19, 1991, U.S. Pat. No. 5,163,967, which is a continuation of application Ser. No. 07/507,002, filed Apr. 10, 1990 (abandoned), which is a continuation of application Ser. No. 07/319,852, filed Mar. 3, 1989 (abandoned), which is a continuation of application Ser. No. 07/101,832, filed Sep. 28, 1987 (abandoned), which is a continuation-in-part of application Ser. No. 06/926,291, filed Nov. 3, 1986, U.S. Pat. No. 4,724,642.

BACKGROUND OF THE INVENTION

This invention relates to outdoor residential constructions, and is particularly concerned with support devices for use in deck construction.

Various types of devices have heretofore been used for supporting and/or connecting building elements, such as horizontal beams, joists, stringers, posts and pillars, to a base slab, footing, foundation of block member. For example, such devices include anchor studs, metal brackets, or other supports or devices which are permanently embedded in the concrete in the manufacturing process of the blocks and which are required to make them functional. Such devices or additional components are used to provide vertical and lateral mechanical connection of building elements to a base or as components to other elements but do not have an individual identity or non-mechanical application which facilitates the inexpensive and convenient construction of a simple deck, such as a deck that may be built by the average home owner on unprepared and unleveled ground typical to a residential backyard.

SUMMARY OF THE INVENTION

According to the present invention and forming a primary objective thereof, a deck construction is provided including a novel construction support device, which amounts to an improvement over prior structures.

A more particular object of the invention is to provide a construction support device of the type described having a novel arrangement of recesses, walls, and sockets for receiving horizontal beams and the like, and also capable of receiving vertical pillars or posts, all in a variety of selected support connections not heretofore available.

Another object of the invention is to provide an embodiment of the invention comprising a plurality of integrated wall portions disposed in a zig zag pattern and forming one or more full width slots for receiving horizontal beams and the like and also forming a rectangular central socket for receiving a vertical pillar or post.

Another object of the invention is to provide a pier block of the type described having a novel arrangement of recesses and central socket for receiving horizontal two-inch thick (1 1/2-inch nominal) surface supports, and also capable of receiving vertical wood posts without mechanical connections or additional components, all in a variety of selected support configurations not heretofore available.

In carrying out these objectives, a construction support device is provided for anchoring a beam or other element to the ground or other building site. The device includes a body having upper and lower portions. The lower portion rests on the building site, and the upper portion includes an open slot for holding a beam edgewise. The slot is formed by spaced-apart side walls. The side walls themselves include connected wall portions, which are integrally joined at right angles.

The slot includes a center socket portion that is adapted for securely holding the bottom end of a vertically oriented post. The center socket portion is formed by the side walls extending at right angles away from each other to form corner sections. The corner sections are spaced apart substantially further than the width of the open slot to provide substantial corner support to the post.

In some cases, the side walls which define the slot are part of spaced-apart projections which extend from the upper portion of the body. These projections can be integrally molded with the body to form a single-cast, one-piece block or pier. Alternatively, they may be formed of plastic or metal and suitably attached to a base.

The invention may be practiced with a pair of recesses emanating from the central socket portion to form a single slot which extends unobstructed across the entire breadth of the body. Alternatively, a second pair of recesses may be employed to form a total of two mutually perpendicular slots.

Support devices in accordance with the invention are particularly suited to the construction of residential decks. Horizontal, coplanar deck support members may be carried by a plurality of the foregoing support devices arranged in rows and columns. The horizontal deck support members are securely seated in the slots defined by the spaced apart side walls.

Where the deck is to be built on uneven ground, the horizontal members can be supported in a level attitude by a plurality of vertical support pillars. The bottom ends of the vertical support pillars are securely seated in one of the center socket portion, while their respective top ends bear the horizontal members in supporting engagement. The height of the vertical support pillars can vary to span the vertical distance between the uneven ground and the desired plane in which the horizontal support members reside.

In one embodiment, the construction support device of the invention comprises a body member having a lower surface which serves as a support on a base such as a slab, footing, or pier block. The body member has one or more recess means arranged to receive horizontal beams and the like. The body member also has a central socket for receiving a vertical pillar or post. The recess means are disposed on each of four sides of the body member at 90 degrees apart and communicate with the central socket and the exterior, the pairs of recesses opposite from each other being aligned whereby construction beams or the like can be laid therein in edge and/or end relation. Also, in such embodiment, the construction device has fastener-receiving means therein for attaching a beam or beams and a pillar together, and also for attaching the assembly to the base. In another embodiment, side edges of the body member at the recess openings have downturned projections shaped on a rear portion thereof to frictionally fit on top of pier blocks for anchoring the body member against lateral shifting.

In another embodiment, the construction support device of the invention is a single cast, one-piece pier block which comprises a body member serving as a capable support on unprepared and unleveled building sites, having localized dips, slopes and random level areas therein. The body member has a single recess means molded into the top surface capable of receiving horizontal deck surface support members and also capable of receiving the bottom end of a vertical wood post or pillar. The recess means can have particular dimensions for using conventional, existing lumber sizes and also such dimensions are such that the required integral strength of the block is maintained due to the manufacturing process and application without the necessity of using reinforcing bar steel or additional integral components. All of these features combine in a structural arrangement which automates and standardizes the manufacture and facilitates marketing, at a lower unit and resale cost, a deck that can be preplanned and pre-cut. Such a deck is simplified and inexpensive, and capable of construction by the average do-it-yourself homeowner who desires a deck on the unprepared and unleveled ground of a typical backyard.

The invention will be better understood and additional objects and advantages will become apparent from the following description taken in connection with the accompanying drawings.

BRIEF DESCRIPTION OF THE DRAWINGS

FIGS. 5, 6, 7 and 8 are perspective views showing various applications of the device of FIG. 1 in association with structural building elements;

DETAILED DESCRIPTION OF PREFERRED EMBODIMENTS

According to the present invention, a construction support device is provided which conveniently provides anchoring of a building element to a building site. As illustrated herein, the invention may be practiced in accordance with a first embodiment of FIG. 1, wherein the construction support device is securely attached to a concrete base or pier. The device of FIG. 1 can be inexpensively molded from plastic or stamped from metal and is simplified in its use and constructions.

Figure 13:
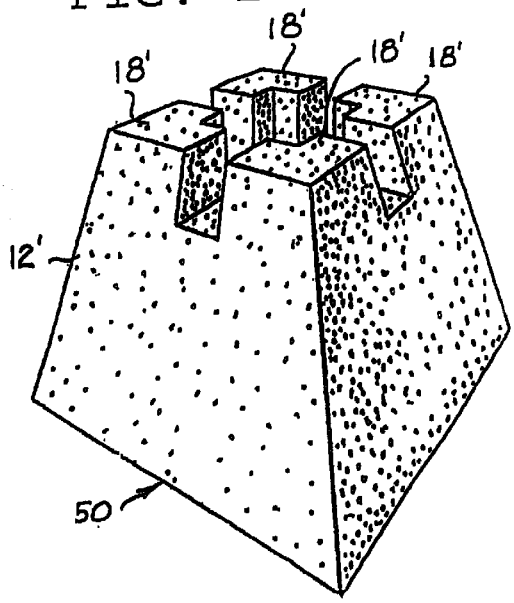
FIG. 13 is a perspective view of a construction support device in accordance with another embodiment of the invention.
Figure 14:
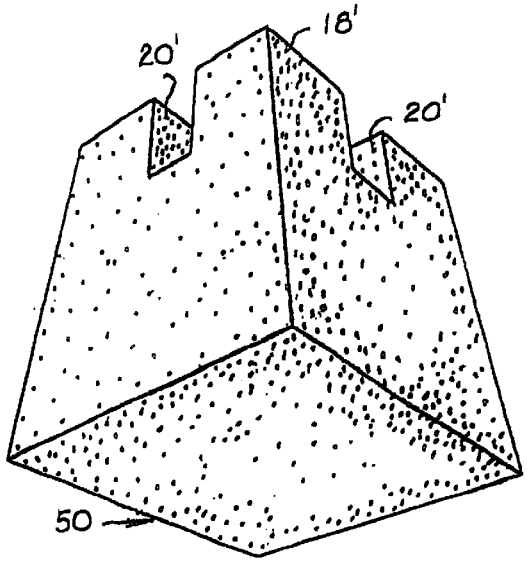
FIG. 14 is a bottom perspective view of the construction support device shown in FIG. 13.
Figure 15:
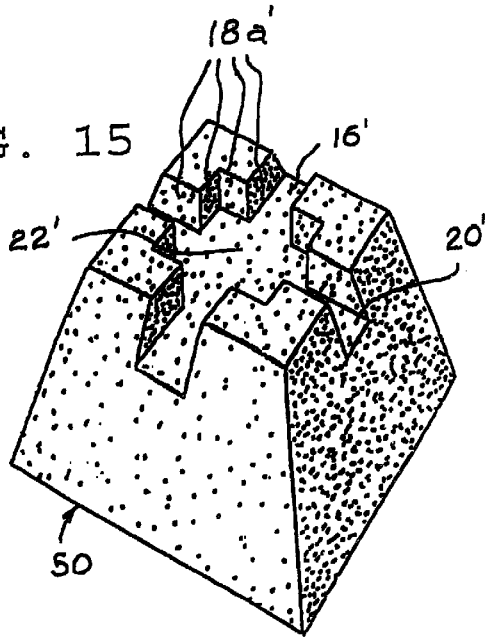
FIG. 15 is a top perspective view of the construction support device shown in FIG. 13.
Figure 16:
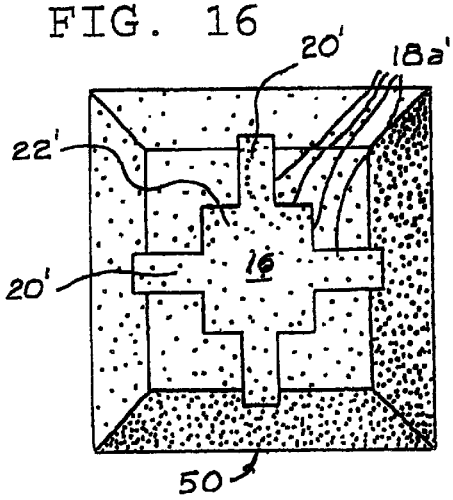
FIG. 16 is a top plan view of the construction support device shown in FIG. 13.
Figure 17:
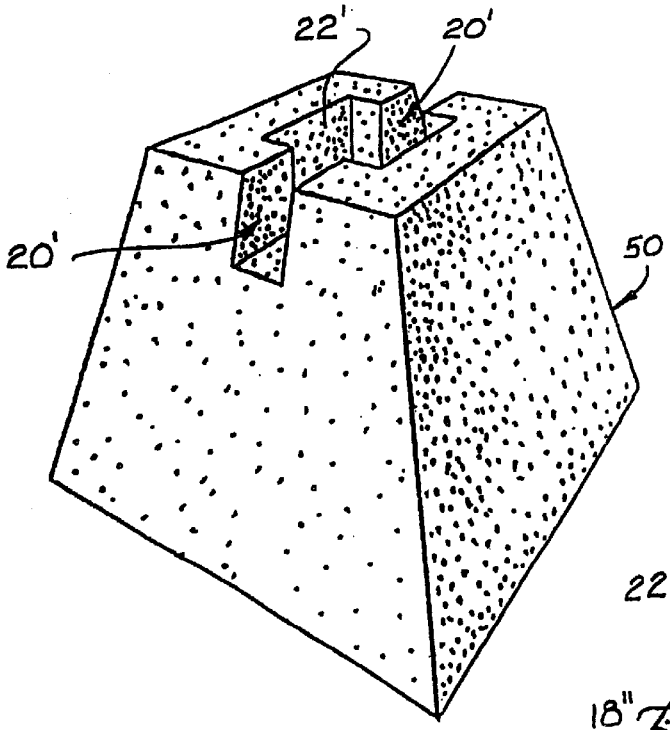
FIG. 17 is a perspective view of a construction support device in accordance with another embodiment of the invention.

Alternatively, the invention may be practiced in accordance with other embodiments, such as shown in FIGS. 13 and 17. There, the device is inexpensively poured from concrete together with a pier block to form a single cast, one-piece body. In either type of embodiment, the invention provides a new and advantageous support for securely seating construction members in either a horizontal or vertical orientation.

With reference first to FIGS. 5 through 8, the numeral 10 represents a base or pier block of conventional structure which is commonly used to support decks, carports, etc. This block is generally constructed of concrete and assumes different shapes. In most cases, the block is tapered to a lesser dimension toward the top. The top and bottom surfaces 12 and 13, respectively, are flat.

FIGS. 1–8 illustrate a construction support device 14 in accordance with a first embodiment of the invention. Construction support device 14 may be molded, stamped, or otherwise formed from a tough plastic or metal. The body member of the device 14 includes a flat bottom wall 16 and four identically shaped or symmetrical upright quarter sections 18. Each of the sections 18 comprises four zig zag panels 18*a* joined integrally at right angles. These symmetrical quarter sections are shaped to form a recess or opening 20 on each side, with oppositely located recesses being laterally aligned. Also, with this quarter section construction, a square central socket 22 is formed. Laterally aligned recesses 20 provide a pair of full width slots open at the sides.

Figure 2:
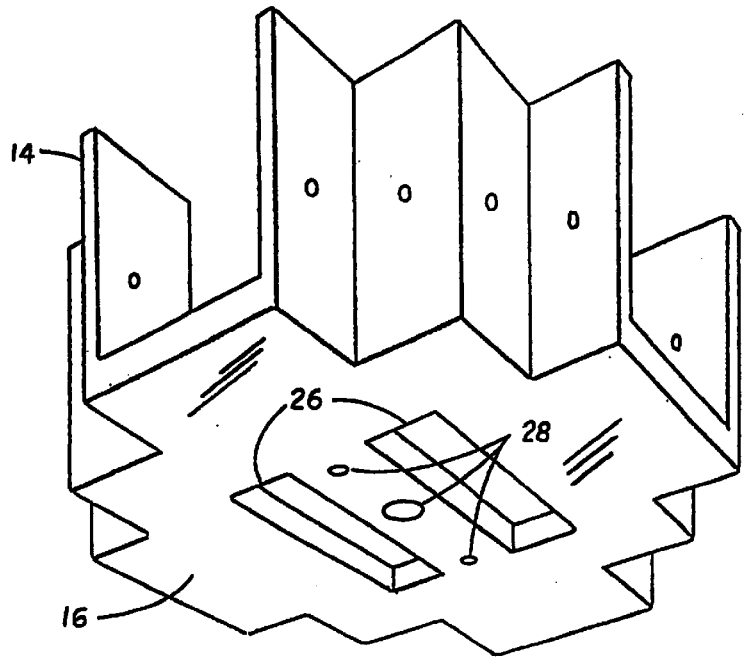
FIG. 2 is a bottom perspective view of the device shown in FIG. 1.

Each of the panel sections 18*a* has one or more apertures 24 therein provided to receive fasteners, to be seen hereinafter, for securement of building elements to the device 14. As seen in FIG. 2, cutouts 26 are provided in the bottom wall 16 for reducing the weight of the member as well as for conserving material. Also, apertures 28 are provided in the wall 16 for secured attachment of the member 14 to a base, such as to a block 10, a concrete slab, or other support means.

Figure 5:
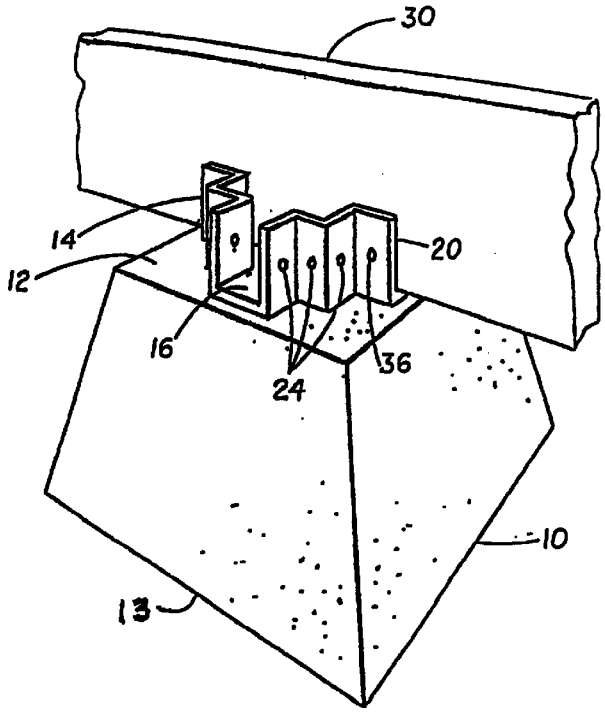
Figure 6:
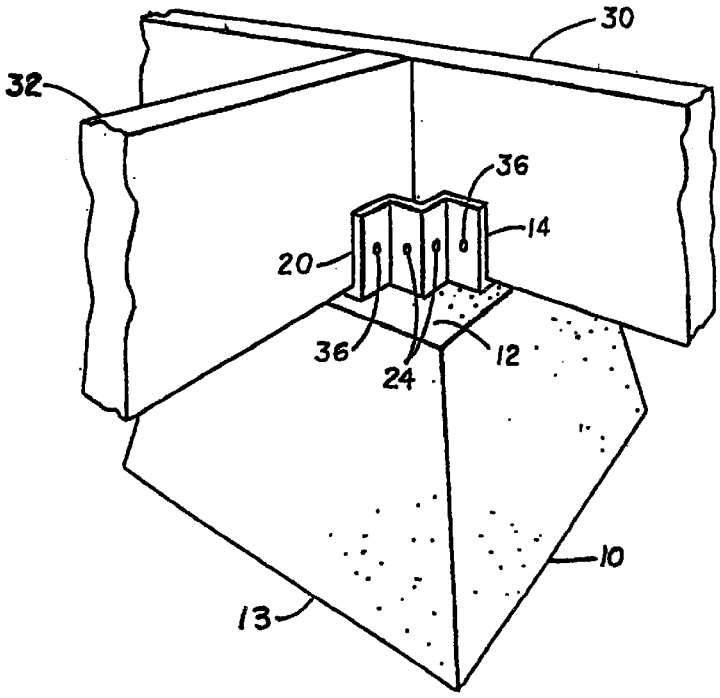

FIGS. 5, 6, 7 and 8 show various applications of the construction device 14 with building elements such as support members and pillars. FIG. 5 for example shows a horizontal decking surface support member 30 seated edgewise on the bottom wall 16 and extending fully through the device and out both side recesses 20. FIG. 6 shows a support member 30 similarly supported as in FIG. 5 but also showing a right angle support member 32 extending through a 90 degree side recess 20 and abutted against the support member 30. FIG. 7 shows a vertical pillar 34 supported on the device 14 and fitted in the central socket 22. FIG. 8 shows a pillar 34 similarly fitted in the socket 22 as in FIG. 7 but also showing side beams 32 extending in from all four of the side recesses. These members may simply be fitted in the respective recesses 20 or socket 22. Preferably, however, secured attachment to the member 14 is accomplished by fasteners 36 extending through the apertures 24. Also, device 14 can first be secured to the base member 10 by fasteners extending through the apertures 28.

Figure 1:
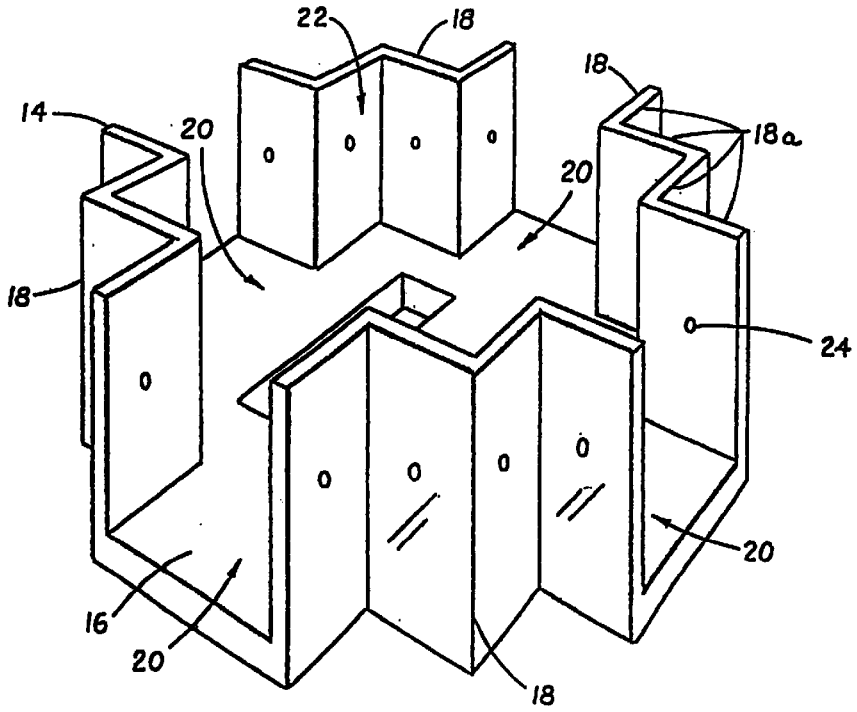
FIG. 1 is a top perspective view of a support device in accordance with a first embodiment of the invention.
Figure 3:
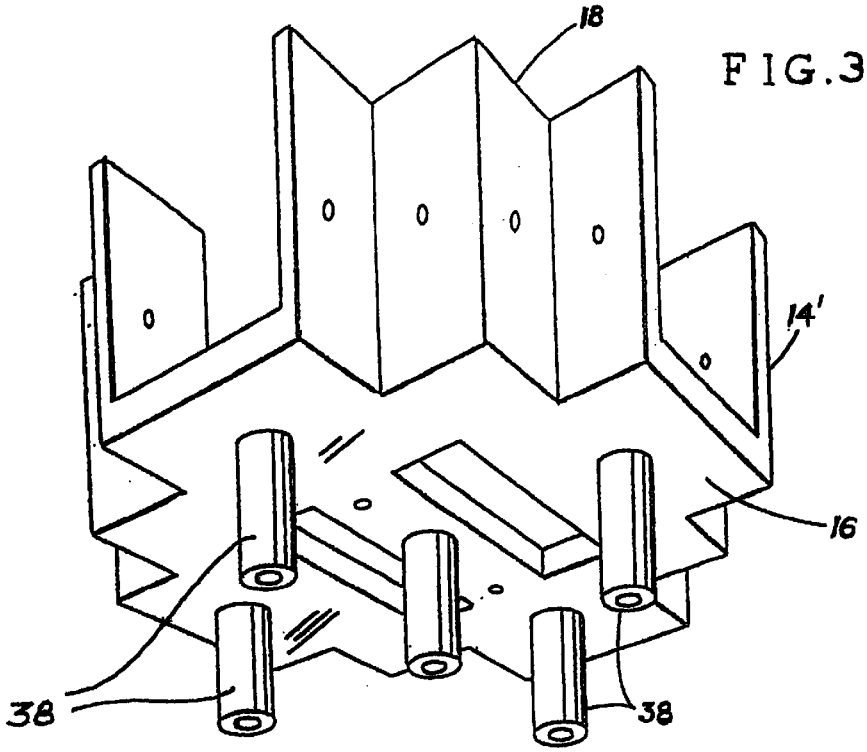
FIG. 3 is a bottom perspective view of a construction support device in accordance with another embodiment of the invention.
Figure 4:
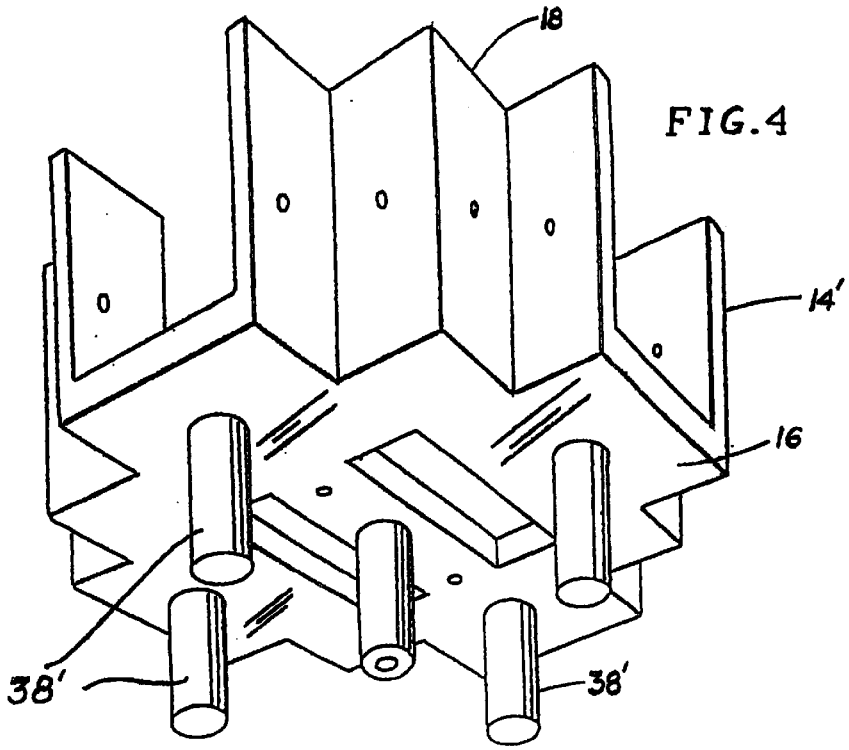
FIG. 4 is a bottom perspective view of a construction support device in accordance with yet another embodiment of the invention.

FIG. 3 is a bottom perspective view of a construction device 14' having a bottom wall 16 and side walls 18 in an arrangement similar to that shown in FIGS. 1 and 2. This structure, however, is formed (such as by integral molding) with a plurality of depending foot member 38. Four of such foot members are shown, as well as a central foot member, but any number of such foot members maybe provided. In the FIG. 3 embodiment, the foot members 38 are hollow whereby long fasteners can be inserted down from the top through the wall 16 and into a base for secured attachment of the construction device 14' to the base. FIG. 4 shows a structure similar to FIG. 3 except that the outer foot members 38' are solid and not hollow. This embodiment may be employed in circumstances where it is not necessary to use vertical fasteners around an outer portion of the member.

FIGS. 9–12 illustrate an embodiment of the invention employing means for anchoring the body member against lateral shifting. In this embodiment, the body member 14" is the same as that shown in FIG. 1 with respect to quarter panel sections 18*a* and their formation of aligned recesses 20 and central socket 22. To accomplish the lateral anchoring feature, the outermost panel section 18*a* of each quarter section has a depending projection or lip 40 defined by a bottom wall portion 42 integral with side extensions 44 and a rear wall portion 46. Rear wall portion 46 preferably angles outwardly toward the bottom to coincide with the angle of the side surfaces of pier block 10. Rear wall portion 46 can extend at a desired angle, so as to have flush engagement with pier block sides or varying shape.

Figure 9:
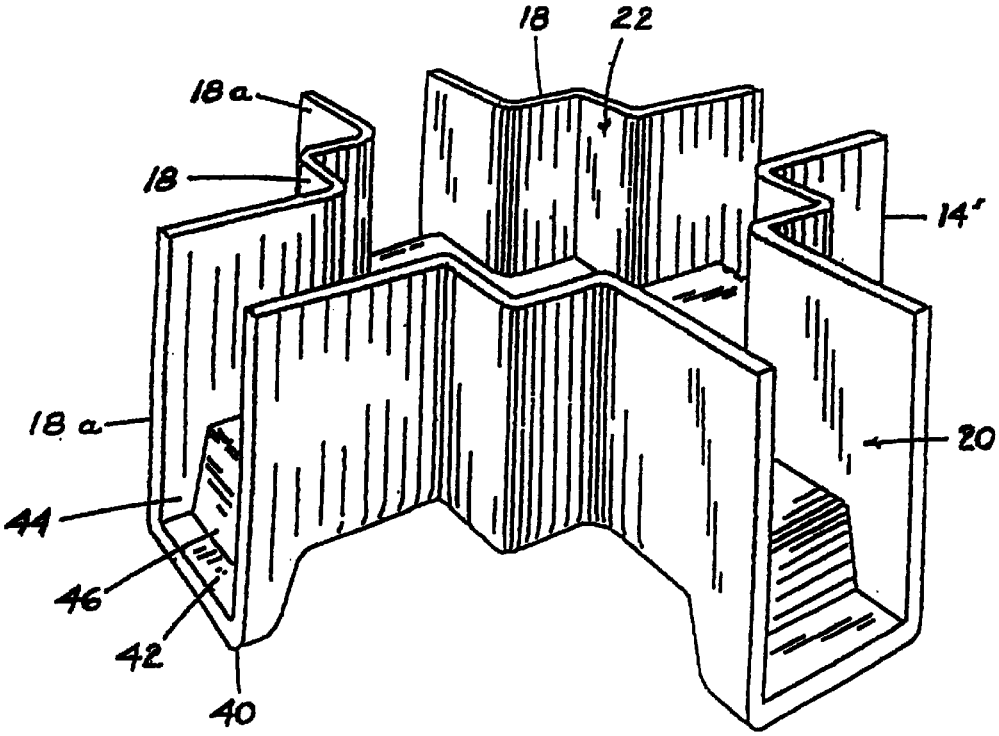
FIG. 9 is a perspective view of a construction support device which includes lateral stabilizing elements in accordance with another embodiment of the invention.
Figure 10:
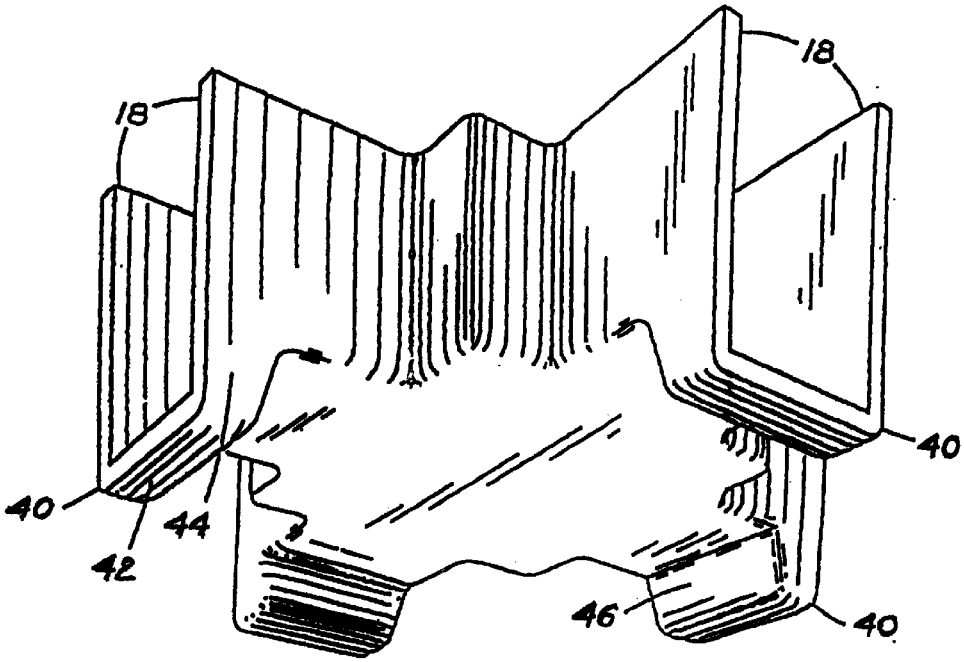
FIG. 10 is a bottom perspective view of the construction support device of FIG. 9.
Figure 11:
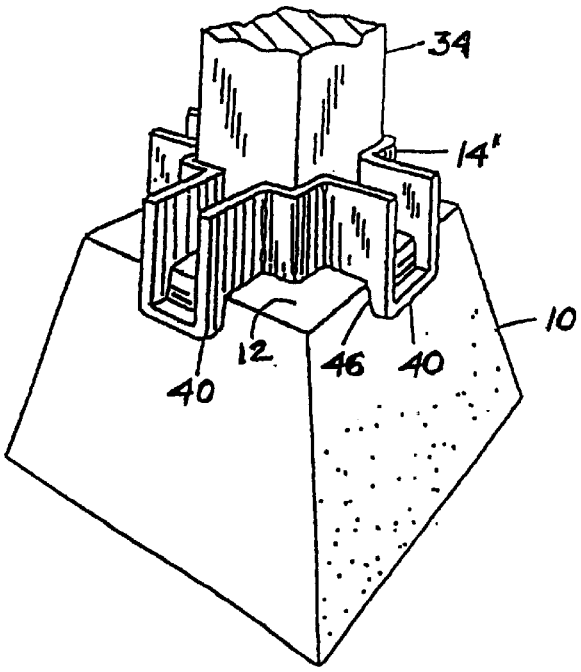
FIGS. 11 and 12 are perspective views showing various applications of the device of FIG. 9 in association with structural building elements.
Figure 12:
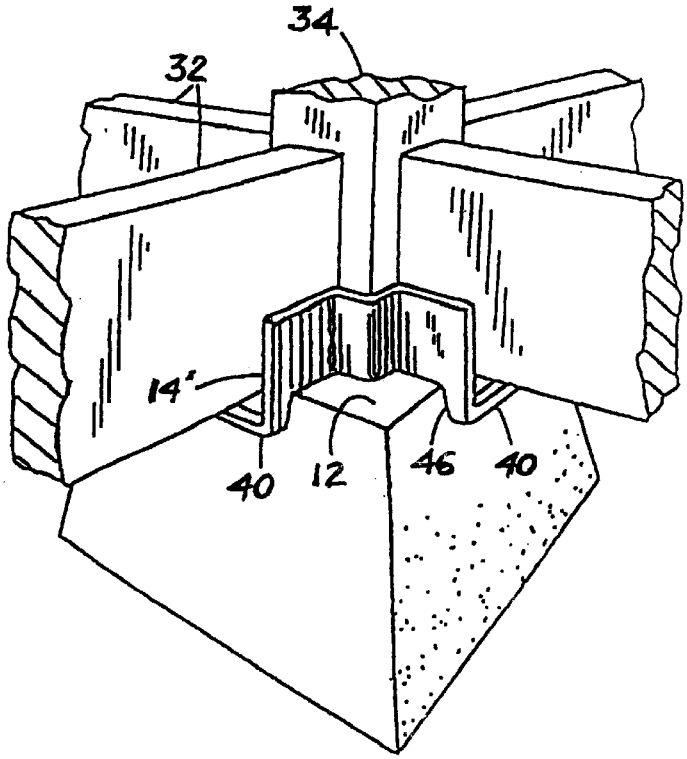

FIGS. 11 and 12 show application of the device 14" of FIG. 9 to a pier block. In such arrangement, the device 14" and the building elements therein are anchored or locked against lateral shifting. Fasteners extending through the bottom wall of the device are not necessary, although such fasteners can be used if desired. The cross dimension of the device between rear wall portions 46 can be preselected according to the size of the pier block so that a snug or frictional fit is provided.

Referring to FIGS. 13–21, it will be seen that the device 14 may be made of concrete and integrally molded into the upper surface 12' of a pier block such as pier block 50. As shown in FIGS. 13–16, the four upright quarter sections 18' include zig-zag walls 18*a'* which project from flat bottom wall 16'. Recesses 20' define two perpendicular slot portions extending across the full width of upper surface 12'. Zig-zag walls 18*a'* also define the four corners of a square central socket 22'.

Figure 18:
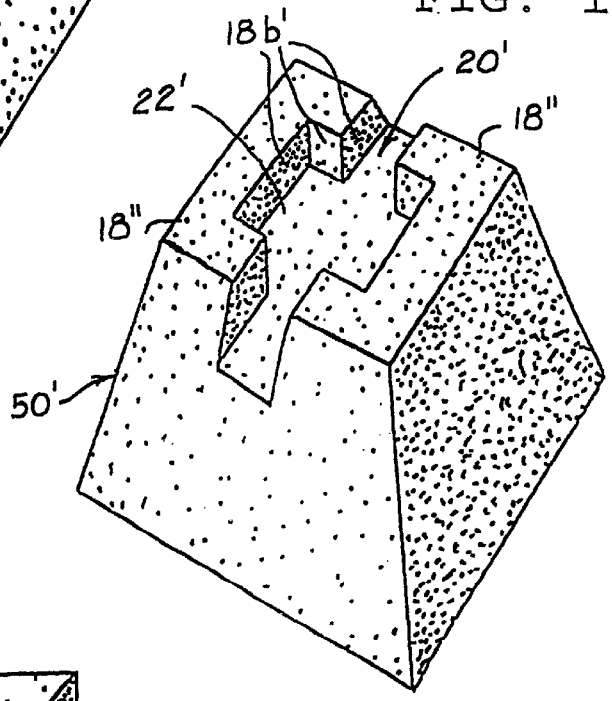
FIG. 18 is a top perspective view of the construction support device shown in FIG. 17.
Figure 19:
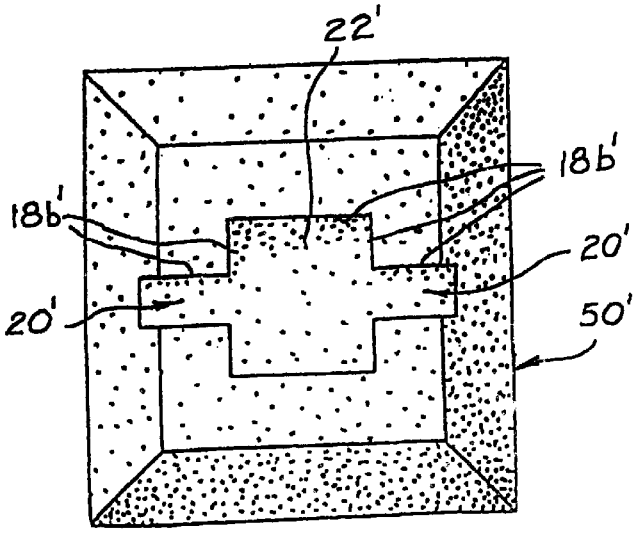
FIG. 19 is a top plan view of the construction support device show in FIG. 17.
Figure 20:
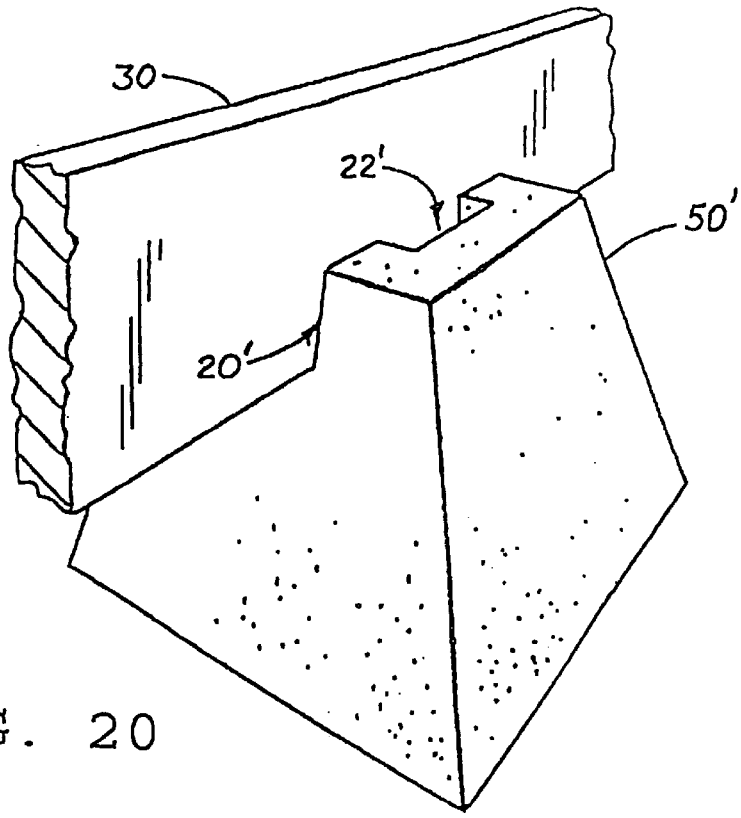
FIGS. 20 and 21 are perspective views showing various applications of the device of FIG. 17 in association with structural building elements.
Figure 21:
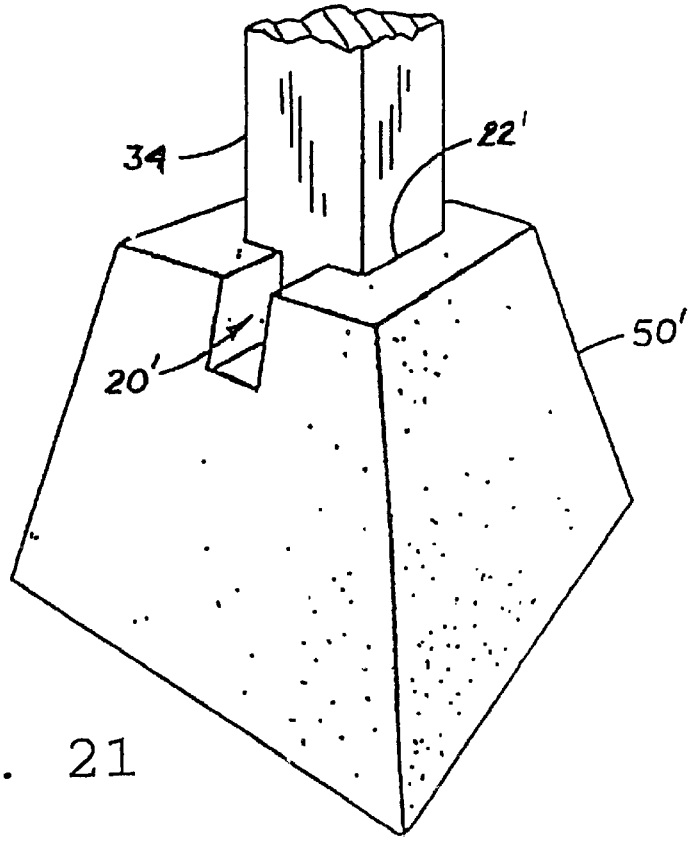

With reference to FIGS. 17–21, the concept of the invention can also utilize a pier block 50' having a central socket portion 22' and only two equal narrower recesses 20' which extend inward from outer edges of two opposite sides of the top surface of the block 50' and lead into the central socket portion, as best shown in FIG. 18. The two narrower recesses 20' form but a single slot for receiving a horizontal decking surface support member 30 which also passes through the central socket portion 22', as shown in FIG. 20. The central socket portion 22' is for receiving vertical pillar supports 34, independent of the two equal narrower recesses 20', as shown by FIG. 21. The horizontal decking surface support members 30 and vertical pillar support members 34 being mutually exclusive to each other in the recess of block 50' and also mutually interchangeable with each other in the same recess of the same block 50'.

Figure 22:
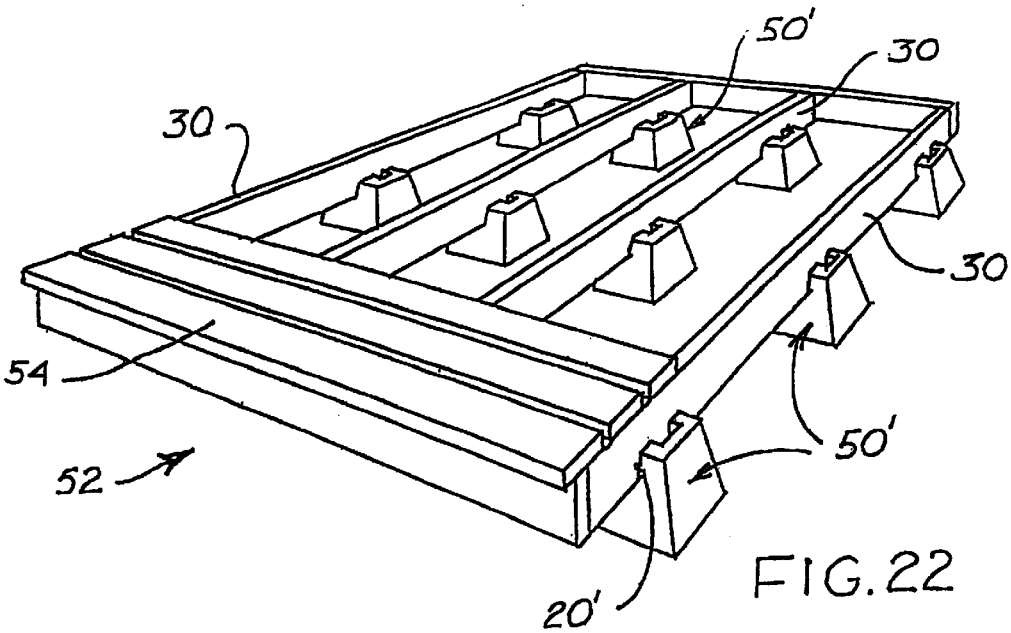
FIG. 22 is a perspective view of a deck construction in accordance with the invention employing the construction support device shown in FIG. 17.
Figure 23:
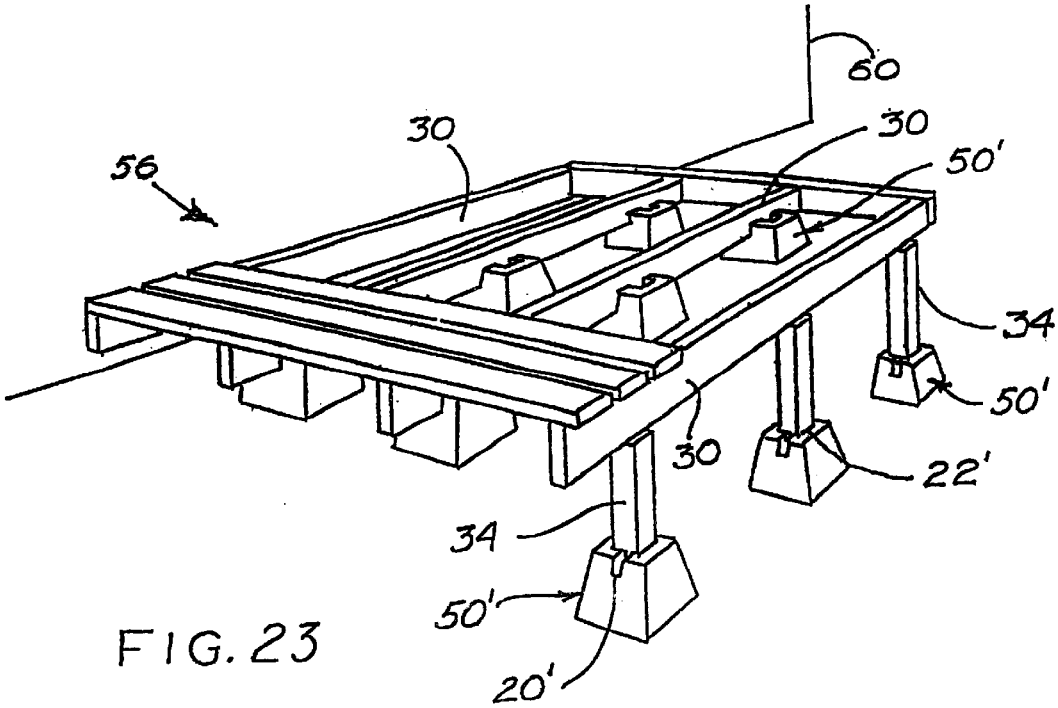
FIG. 23 is a perspective view of another deck construction in accordance with the invention employing the construction support device shown in FIG. 17.

The combination of slots and sockets allows a support in accordance with the invention to accommodate both vertical and horizontal beams, and is particularly well-suited for constructing decks on unprepared and unleveled building sites, two examples of those being shown in FIGS. 22 and 23. Such decks, by using the present block, are extremely simplified in their construction and can be supplied in pre-planned, pre-cut units. Other advantages also exist in the structure, as will be apparent hereinafter.

The deck shown in FIG. 22, designated by reference numeral 52, comprises the pier blocks 50' as the base or ground support for the deck and can have such lumber as two-inch thick (1½ inch thick nominal) horizontal decking surface support member 30 received by the two equal narrower portions 20', also passing through the central socket portion 22' when the vertical pillar support 34 is not in the block 50', those members 30 then supporting the deck surface structure 54 which is nailed in place and those blocks 50' directly receiving member 30 being on localized high or level ground within an unprepared and unleveled building site.

The deck shown in FIG. 23, designated by the numeral 56, similarly uses some pier blocks 50' as described above and also illustrates the use of some blocks 50' as the base or ground support for vertical pillar supports 34 set in the central socket 22' when the member 30 is not in block 50, member 34 then providing support to member 30 when member 30 is not directly received by block 50 due to localized variations of the ground within an unprepared and unleveled building site. A deck support member 30 can also be fastened to a building 60, as shown in FIG. 23.

The particular structure of the manufactured pier blocks 50 and 50' makes it possible to construct an extremely simplified deck and one which can be pre-planned and pre-cut if desired. That is, such lumber as 2-inch thick deck support members 30 and vertical wood pillars 34 which can be used therewith comprise conventional existing material, namely, the two-inch thick deck support members 30 can comprise 2×6's or 2×4's and pillars 34 can comprise 4×4's.

The two equal narrower recesses 20' can be 2 inches deep and have a width of 1¾ inches. This latter dimension would receive conventional finished 2×6's (1½ inches thick) and 2×4's (also 1½ inches thick). 2×6's and 2×4's have finished height dimensions of 5½ and 3½ inches, respectively, whereby the deck support members, whether 2×6's or 2×4's, project to a minimum necessary height above the top surface of the blocks 50 when seated in the recess for supporting the decking thereon.

The central socket portion 22' can be 2 inches deep, similar to the recess portion 20'. Such socket is square, and can have dimensions of 3¾ inches for receiving a conventional finished 4×4 (3½ inches square) lumber support pillar. The vertical pillar becomes sufficiently fixed in socket portion 22' in the block for deck construction purposes, as does the deck horizontal support member in the two narrower portions 20', also being within the central socket portion 22' when the member 34 is not in the block 50, for lateral stability.

Pier blocks 50 and 50' are designed to provide support to a deck on unleveled or unprepared building sites with no additional components required. For this purpose, the blocks 50 and 50' are tapered to a larger dimension toward the bottom. The top and bottom surfaces are flat and square. The enlarged bottom surface allows the block to serve as its own footing. When two of such recesses 20' are provided, they are standardly aligned across the block. Furthermore, the width of these recesses is less than one-third the width of the block at the top, thus maintaining lateral integral strength of the block. This arrangement maintains a strong concrete block without the necessity of re-bar reinforcement and thus contributes to manufacture of a pier block and deck structure in a pre-planned and pre-cut unit which is also sufficiently simplified in its use, standardized in its manufacture, and sufficiently inexpensive for deck construction by the average do-it-yourself homeowner.

Since the recess can be two inches deep, the recesses of the pier blocks 50 and 50' of FIGS. 13 and 17 automatically and non-mechanically center the horizontal decking surface support member 30 and vertical pillars 34 in the pier block (FIGS. 20 and 21) and automates connection and securement of these support members to the pier block for deck constructions 52 and 54 shown in FIGS. 22 and 23. Mounted engagement of the horizontal surface support members and vertical pillars with the block is accomplished without metal-brackets or embedded connectors thus allowing individual blocks of a deck construction on unleveled and unprepared building sites to be adjusted without the need of any disassembly of the deck (i.e. removing bolts, nails or screws). Also, the recess of the pier blocks 50 and 50' maintains horizontal and vertical members in parallel which is critical in construction of the deck.

It is to be understood that the forms of our invention herein shown and described are to be taken as preferred examples of the same and that other changes in the shape, size and arrangement of parts may be resorted to without departing from the spirit of our invention or the scope of the following claims.

We claim:

1. A deck construction for a deck constructed on a building site, comprising, in combination, a plurality of concrete blocks and a plurality of generally vertically oriented post members having longitudinal external corners, said blocks being arranged in generally parallel rows with each of said blocks comprising a one-piece body structure having a generally polygonal external peripheral surface, an upper end surface and a lower end surface adapted for supporting engagement with the building site, each upper end surface having two pairs of open aligned recesses formed therein disposed in substantially mutually perpendicular relation to each other with each recess intersecting a centrally disposed enlarged open socket formed in said upper end surface, said recesses each being defined by laterally spaced-apart sidewall surfaces and a base surface and intersecting said external peripheral surface at diametrically opposite positions, each said enlarged open center socket being defined by a central base surface and by socket sidewall surfaces forming four mutually opposed right angle corners spaced apart farther than said spaced-apart sidewalls forming said recesses, said blocks each directly receiving a lower end of one of said generally vertically oriented posts in said socket, said longitudinal corners of said lower end of each said post frictionally engaging said comers of said socket and said lower end of said post being abuttingly supported only by said surfaces defining said socket.

2. The deck construction as defined in claim 1 wherein said open aligned recesses are free of reinforcing bars so that a horizontally oriented construction element can extend freely through a pair of said open aligned recess and the corresponding centrally disposed socket fully across the entire width of said upper end surface of the corresponding block when not supporting a generally vertically oriented post in said corresponding socket.

3. A deck construction for a deck constructed on a building site, comprising, in combination, a plurality of concrete blocks and a plurality of generally vertically oriented post members having longitudinal external comers, said blocks being arranged in generally parallel rows with each of said blocks comprising a one-piece body structure having an upper end surface and a lower end surface adapted for supporting engagement with the building site, each upper end surface having two pairs of open aligned recesses formed therein disposed in substantially mutually perpendicular relation to each other with each recess intersecting a centrally disposed enlarged open socket formed in said upper end surface, said recesses each being defined by laterally spaced-apart sidewall surfaces and a base surface and intersecting said external peripheral surface at diametrically opposite positions, each said enlarged open center socket being defined by a central base surface and by socket sidewall surfaces forming four mutually opposed right angle corners spaced apart farther than said spaced-apart sidewalls forming said recesses, said blocks each directly receiving a lower end of one of said generally vertically oriented posts in said socket, said longitudinal comers of said lower end of each said post frictionally engaging said comers of said socket and said lower end of said post being abuttingly supported only by said surfaces defining said socket.

* * * * *

UNITED STATES PATENT AND TRADEMARK OFFICE

CERTIFICATE OF CORRECTION

PATENT NO. : 6,550,201 B2
DATED : April 22, 2003
INVENTOR(S) : Hoffman et al.

It is certified that error appears in the above-identified patent and that said Letters Patent is hereby corrected as shown below:

Column 8,
Lines 12, 26, 46 and 47, change “comers” to -- corners --.

Signed and Sealed this

Sixteenth Day of September, 2003

JAMES E. ROGAN
*Director of the United States Patent and Trademark Office*